US008427398B2

(12) United States Patent
Han et al.

(10) Patent No.: US 8,427,398 B2
(45) Date of Patent: Apr. 23, 2013

(54) PICTURE ELEMENT STRUCTURE OF CURRENT PROGRAMMING METHOD TYPE ACTIVE AND DRIVING METHOD OF DATA LINE

(75) Inventors: Min-Koo Han, Seoul (KR); Jae-Hoon Lee, Seoul (KR); Woo-Jin Nam, Gwacheon-si (KR)

(73) Assignee: Seoul National University Industry Foundation, Bongcheon-Dong, Gwanak-Gu, Seoul (KR)

( * ) Notice: Subject to any disclaimer, the term of this patent is extended or adjusted under 35 U.S.C. 154(b) by 1589 days.

(21) Appl. No.: 11/351,134

(22) Filed: Feb. 9, 2006

(65) Prior Publication Data

US 2006/0145989 A1 Jul. 6, 2006
US 2009/0153459 A9 Jun. 18, 2009

Related U.S. Application Data

(63) Continuation of application No. PCT/KR2004/003173, filed on Dec. 3, 2004.

(51) Int. Cl.
*G09G 3/30* (2006.01)

(52) U.S. Cl.
USPC ..... 345/76; 345/77

(58) Field of Classification Search ..... 345/92, 345/76–83; 315/169.3
See application file for complete search history.

(56) References Cited

U.S. PATENT DOCUMENTS

| | | | | |
|---|---|---|---|---|
| 6,753,655 | B2 * | 6/2004 | Chen et al. | 315/169.3 |
| 7,046,240 | B2 * | 5/2006 | Kimura | 345/212 |
| 7,327,357 | B2 * | 2/2008 | Jeong | 345/204 |
| 7,372,437 | B2 * | 5/2008 | Koyama | 345/76 |
| 7,382,340 | B2 * | 6/2008 | Kim et al. | 345/76 |
| 7,382,342 | B2 * | 6/2008 | Uchino et al. | 345/92 |
| 2002/0196212 | A1 * | 12/2002 | Nishitoba et al. | 345/76 |
| 2004/0100202 | A1 * | 5/2004 | Koyama | 315/169.3 |
| 2004/0155841 | A1 * | 8/2004 | Kasai | 345/76 |
| 2004/0174349 | A1 * | 9/2004 | Libsch et al. | 345/204 |
| 2004/0196239 | A1 * | 10/2004 | Kwon | 345/92 |
| 2005/0067971 | A1 * | 3/2005 | Kane | 315/169.3 |
| 2005/0122052 | A1 * | 6/2005 | Horiuchi et al. | 315/169.2 |
| 2005/0156836 | A1 * | 7/2005 | Yoneyama et al. | 345/76 |
| 2005/0264492 | A1 * | 12/2005 | Knapp et al. | 345/76 |

FOREIGN PATENT DOCUMENTS

| | | |
|---|---|---|
| JP | 2001-147659 | 5/2001 |
| JP | 2004-094211 | 3/2004 |

* cited by examiner

*Primary Examiner* — Amare Mengitsu
*Assistant Examiner* — Nelson Lam
(74) *Attorney, Agent, or Firm* — Cha & Reiter, LLC

(57) ABSTRACT

The present invention provides a novel structure of picture elements in current programming-type semiconductor devices, and in particular, the structure of picture elements of an active matrix organic light emitting diode (OLED) display. The device makes a self-compensation for OLED current deviations due to the deterioration in threshold voltage and uneven electric characteristic in thin film transistors. The invention also provides a method for driving a data driver capable of compensating for the uneven electric characteristic of thin film transistors in the driver for driving picture elements in the current programming-type active matrix OLED display device.

4 Claims, 12 Drawing Sheets

PICTURE ELEMENT STRUCTURE OF CURRENT PROGRAMMING METHOD TYPE ACTIVE AND DRIVING METHOD OF DATA LINE

The present application is a Continuation of international application PCT/KR04/003173 filed on Dec. 3, 2004.

The present invention relates generally to the structure of picture elements in an active matrix organic light emitting diode (OLED) display and, in particular, to the structure of current-programming type picture elements suitable for making a self-compensation for current deviation in OLED resulting from the deterioration in a threshold voltage of OLED and non-uniform electric characteristic in thin film transistors.

BACKGROUND ART

It is so far known from the state of the art that an active matrix liquid crystal display (LCD) using a low temperature polycrystalline silicon thin film transistor (LTPS-TFT) generally provides better driving capability and higher degree of integration than a display adopting amorphous silicon thin film transistors (a-Si TFT) currently in wide use for monitors of notebook computers and desktop personal computers. Thanks to such an advantage, the active matrix LCDs tend to be more frequently adopted for a high resolution LCD device.

In the meantime, an active matrix OLED device has recently emerged as one of the most competitive next generation of display units, in which the brightness of light emitting elements is subject to the changes in the amount of current flowing through an organic thin film element, so most important in the active matrix OLED is to secure the uniformity in thin film transistors, for example, the uniformity in threshold voltage ($V_{th}$) and field effect mobility. This is because a uniform current flow in these picture elements can be achieved by compensation of the threshold voltage in TFT. However, it is known from the state of the art that it is very difficult to manufacture an LTPS TFT with such a desired uniformity in threshold voltage and field effect mobility, which is usually processed under a low temperature environment of less than about 450° C. Therefore, various solutions have been so far sought to ensure the uniformity in TFT, with accesses in the side of physical circuits, for instance, among others, by providing a compensation circuit to each picture element in an active matrix OLED panel.

The basic picture cell scheme in an active matrix OLED may be generally divided into two categories, that is to say, a voltage programming type of inputting picture data with voltage and a current programming type of inputting picture data with current.

FIG. 1 represents the structure of picture elements widely used in the conventional current programming type of active matrix OLED, and FIG. 2 represents a timing diagram in the picture element of FIG. 1.

Referring to FIGS. 1 and 2, it is shown that a prior-art current programming type of picture element is configured to have four TFTs $T_1$ to $T_4$ and a capacitor $C_{stg}$, provided that two TFTs $T_3$ and $T_4$ of the four TFTs have the substantially identical electrical characteristic. Of this circuit configuration in FIG. 1, TFTs $T_1$ and $T_2$ serve as a switch as in an active matrix LCD, the capacitor $C_{stg}$ serves to store a data voltage corresponding to a programmed current, and TFT $T_4$ serves to have the current corresponding to the data voltage stored in capacitor $C_{stg}$ flow into the OLED.

In the basic structure of picture element as shown in FIG. 1, the relationship between the input data current and the output OLED current can be obtained from the following formula:

$$I_{DATA}=\tfrac{1}{2}\times k3\times(V_{GS}-V_{DD}-V_{th_T3})^2$$

$$I_{OLED}=\tfrac{1}{2}\times k4\times(V_{GS}-V_{DD}-V_{th_T4})^2$$

wherein k represents a current-voltage relation in a saturation area, that is, $k=\mu\times Cox\times W/L$, in which $\mu$ represents a field effect mobility, Cox a capacitance of insulating layer, W a channel width, and L a channel length, respectively.

Provided that the electrical characteristics of TFTs $T_3$ and $T_4$ are the same to each other in each picture element, the current scaling ratio $I_{OLED}/I_{DATA}$ may be equal to k4/k3. Therefore, even if a threshold voltage in TFT changes in a current programming type of picture element, it is allowed to output an OLED current only dependent upon the data current irrespectively of the threshold voltage provided that the adjacent two TFTs (for instance, $T_3$ and $T_4$) in each picture element have the substantially same electrical characteristics.

Accordingly, it is appreciated that in case where the OLED threshold voltage deteriorates as a panel operating time becomes longer, the aforementioned prior-art picture cell structure will have a disadvantage that it causes the deviation in OLED output current to occur owing to kink characteristic in TFT $T_4$.

SUMMARY OF INVENTION

It is, therefore, an object of the present invention, with a view to overcome the aforementioned disadvantage, to provide the new structure of picture elements in a current programming type of active matrix organic light emitting diode (OLED) display. The structure makes it possible to compensate for OLED current deviations due to the deterioration in threshold voltage and uneven electrical characteristic in TFT elements between picture elements, thereby allowing the OLED picture elements to provide uniform light emitting characteristic.

It is another object of the present invention to provide the picture element structure in a current programming type of active matrix OLED display that makes it possible to enlarge a current control width per gray in a current data driver stage for controlling a current source, thanks to lowering the current scaling ratio as compared to the conventional structure of picture element.

It is still another object of the present invention to provide the picture element structure in a current programming type of active matrix OLED display that is adapted to be less sensitive to the signal delay (RC-delay) phenomenon resulted from a time constant induced by parasitic resistance and capacitance in a data metal line, while inputting more data current to provide an output current in a low level.

According to one aspect of the present invention, a picture element structure in a current programming type of active matrix OLED display comprises:

first and second switching transistors for selecting a driving picture element based upon a scan signal applied from an exterior, said first and second switching transistors being adapted to receive a data current;

a capacitor for storing electric charges applied from the first and second switching transistors;

a third driving transistor adapted to be selected by the first and second transistors, for writing the data current thereto and receiving an external power source;

a fourth driving transistor formed of a current-mirror structure with the third transistor, for receiving a voltage based upon the electric charges stored in the capacitor to supply a current to a corresponding picture element; and a fifth transistor connected in series to the fourth driving transistor, for making an output resistance of the fourth driving transistor to increase.

BRIEF DESCRIPTION OF THE DRAWING

The foregoing and other features and advantages of the invention will be apparent from the following detailed description of a preferred embodiment as illustrated in the accompanying drawings, wherein same reference characters refer to the same parts or components throughout the various views. The drawings are not necessarily to scale, but the emphasis instead is placed upon illustrating the principles of the invention, wherein.

DESCRIPTION OF THE INVENTION

Hereinafter, a preferred embodiment of the present invention will be described in more detail with reference to the attached drawings. In the following description, for purposes of explanation rather than limitation, specific details are set forth such as the particular architecture, interfaces, techniques, etc., in order to provide a thorough understanding of the present invention. However, it will be apparent to those skilled in the art that the present invention may be practiced in other embodiments, which depart from these specific details. For the purpose of simplicity and clarity, detailed descriptions of well-known devices and methods are omitted so as not to obscure the description of the present invention with unnecessary detail.

Figure 3:
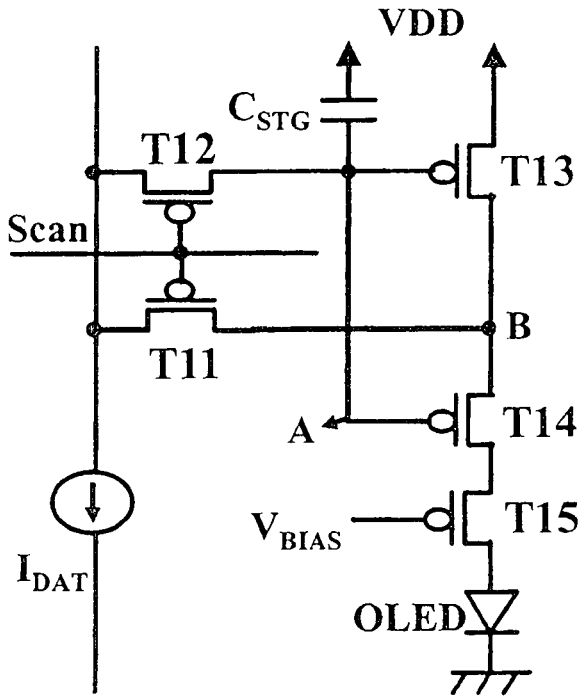
FIG. 3 schematically shows a picture element structure in a current programming type of active matrix OLED according to a first embodiment of the present invention.
Figure 4:
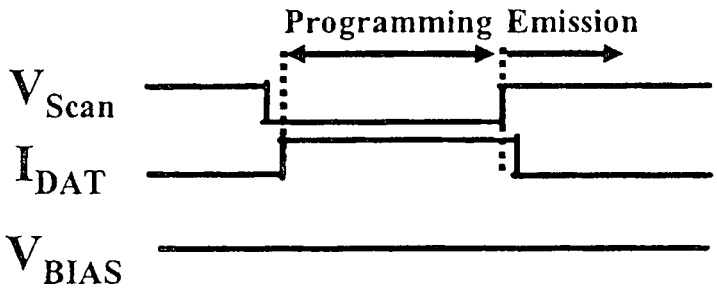
FIG. 4 shows a timing diagram of operation in FIG. 3.

FIG. 3 schematically shows the structure of picture element in a current programming type of active matrix OLED according to a first embodiment of the present invention, and then FIG. 4 shows a timing diagram of operation in FIG. 3. Referring now to FIG. 3, it is seen that the picture element in a current programming type of active matrix OLED according to the preferred embodiment of the present invention is configured to have five P-type thin film transistors (TFTs) $T_{11}$ to $T_{15}$ and a capacitor $C_{STG}$, in such a manner that a DC signal $V_{BIAS}$ in addition to a scan signal and a data signal $I_{DATA}$, which are essential signals for the picture element, is further applied to a gate of TFT $T_{15}$. It should be appreciated that this embodiment as described above also utilizes a characteristic that threshold voltages and field effect mobility in TFT $T_{13}$ and TFT $T_{14}$ are substantially identical to each other, as is with the current-mirror structure indicated in the known structure of FIG. 1. In a low temperature polycrystalline silicon thin film transistor (LTPS-TFT) process utilizing eximer laser, those adjacent polycrystalline silicon TFTs simultaneously crystallized with the same laser beam have the substantially identical electrical characteristics to each other, so they are also commonly applied to a current programming type OLED pixel circuit utilizing such a current-mirror configuration.

Now, the principle of operation according to the preferred embodiment of the present invention will be described in further detail referring to the aforementioned construction. TFTs $T_{11}$ and $T_{12}$ are turned ON during a gate selection time, while $V_{GS_T14}$ equals to zero, so TFT $T_{14}$ turns OFF. Thus, a data current $I_{DAT}$ flows from VDD of TFT $T_{13}$ operating in a saturation region and then capacitor $C_{STG}$ stores a voltage $V_A$ at a node A determined using the following mathematical formula (1).

$$V_A = VDD - \sqrt{\frac{2I_{DAT}}{k_{13}\mu}} + V_{TH} = VDD - X + V_{TH} \tag{1}$$

wherein k=Cox W/L ($k_{13}$=Cox $W_{T13}/L_{T13}$), and X may be transposed by the following formula:

$$X = \sqrt{\frac{2I_{DAT}}{k_{13}\mu}}$$

The voltage $V_A$ at node A may be expressed using the below two functions in conjunction with some electrical characteristics such as $I_{DAT}$, mobility and threshold voltage of a driving TFT in a respective picture element. While TFTs $T_{11}$ and $T_{12}$ are keeping an OFF state after a gate selection session, the current $I_{OLED}$ flows through TFT $T_{13}$ operating in a linear area, represented by the below formula (2), and TFT $T_{14}$ operating in a saturation area, represented by the formula (3). The reason why these TFTs $T_{13}$ and $T_{14}$ are allowed to operate in the linear area and the saturation area is because the gate voltages of TFTs $T_{13}$ and $T_{14}$ have the same value $V_A$.

$$I_{OLED}=I_{DS3}=\mu k_{13}[(V_A-VDD-V_{TH})(V_B-VDD)-\tfrac{1}{2}(V_B-VDD)^2]=\mu k_{13}(-XY-\tfrac{1}{2}Y^2) \quad (2)$$

$$I_{OLED}=I_{DS4}=\tfrac{1}{2}\mu k_{14}(V_A-VDD-V_B)^2=\tfrac{1}{2}\mu k_{14}(X+Y)^2, \text{let } Y=V_B-VDD \quad (3)$$

Expressing Y as a function of X using the relation of the formula (2)=the formula (3):

$$Y=-X\pm\frac{\sqrt{k_{13}(k_{13}+k_{14})}}{k_{13}+k_{14}}X$$

wherein the calculated value of Y is put into the above formulae (2) or (3) in order to express $I_{OLED}$ with respect to $I_{DAT}$, thereby making the following formula.

$$I_{OLED}=\frac{1}{2}\mu k_{14}\frac{k_{13}(k_{13}+k_{14})}{(k_{13}+k_{14})^2}X^2=\frac{1}{2}\mu k_{14}\frac{k_{13}(k_{13}+k_{14})}{(k_{13}+k_{14})^2}\frac{2I_{DAT}}{k_{13}\mu}$$

Therefore, the current I may be expressed using the following formula:

$$I_{OLED}=\frac{k_{14}}{k_{13}+k_{14}}I_{DAT}$$

As a result, the OLED current $I_{OLED}$ can be expressed using a linear equation in terms of only the data current $I_{DAT}$, whereby $I_{OLED}$ in the picture element circuit can be kept independently of non-uniformity of a poly-Si TFT appearing in each picture element.

Further, it is noted that the circuit implemented according to the present invention operates in a cascade configuration by means of TFT $T_{15}$. As a threshold voltage in OLED increases, it is meant that in a conventional 4-TFT picture element scheme a drain node voltage in a transistor supplying a current to OLED increases, thereby producing a decreased output current. The reason is because a so-called kink effect is necessarily caused in the output characteristic of low temperature polycrystalline silicon thin film transistor (LTPS-TFT).

In a 5-TFT picture element configuration according to the present invention, a TFT $T_{15}$ serves as a resistor always turned ON, so the current drop phenomenon can be suppressed by artificially increasing the output resistance of a driving transistor T14.

Figure 1:
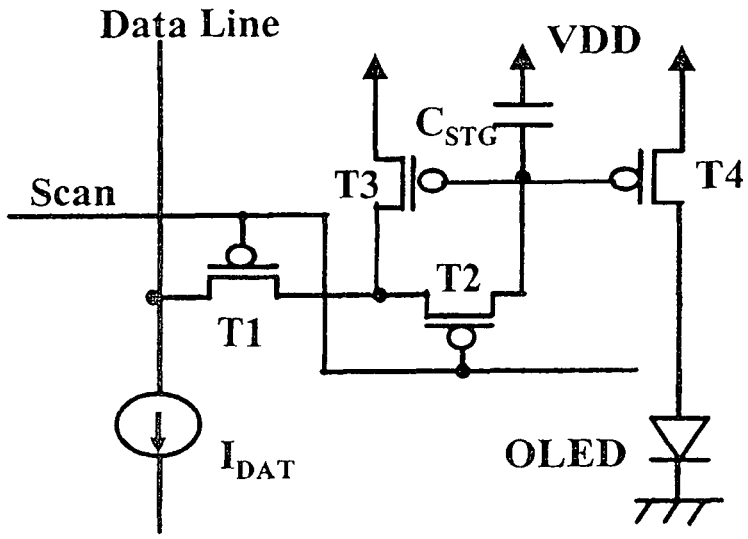
FIG. 1 schematically shows a prior art picture element structure in a current programming type of active matrix OLED to compensate for a threshold voltage in TFT.
Figure 2:
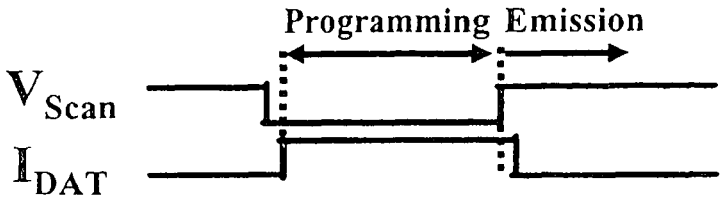
FIG. 2 shows a timing diagram of operation in FIG. 1.
Figure 5:
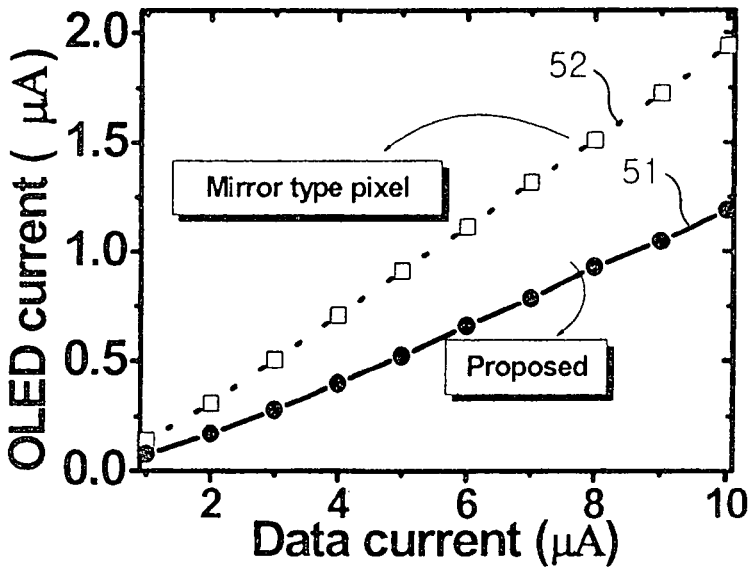
FIG. 5 shows the comparison between the current scaling ratios respectively taken in picture element structures of FIG. 1 and FIG. 3.

FIG. 5 is a comparative graph illustrating the current scaling ratios respectively taken in the proposed picture cell scheme according to the first embodiment of the present invention as shown in FIG. 3 and that of a prior art in FIG. 1. According to FIG. 5, it is appreciated that the current scaling ratio (51) in the first embodiment of the invention gets lower than the current scaling ratio (52) in the prior art scheme. If the current scaling ratio becomes lower, it would affect an increase in a current control width per 1-gray in a current data driver stage controlling a current source, thereby leading to a considerable advantage upon design of the data drivers. Simultaneously, as it is allowed to input more data current to supply a current at low level, the circuit will become less sensitive to the signal delay phenomenon, i.e. RC delay, owing to a time constant by a capacitance and a parasitic resistance in data metal lines.

Figure 6A:
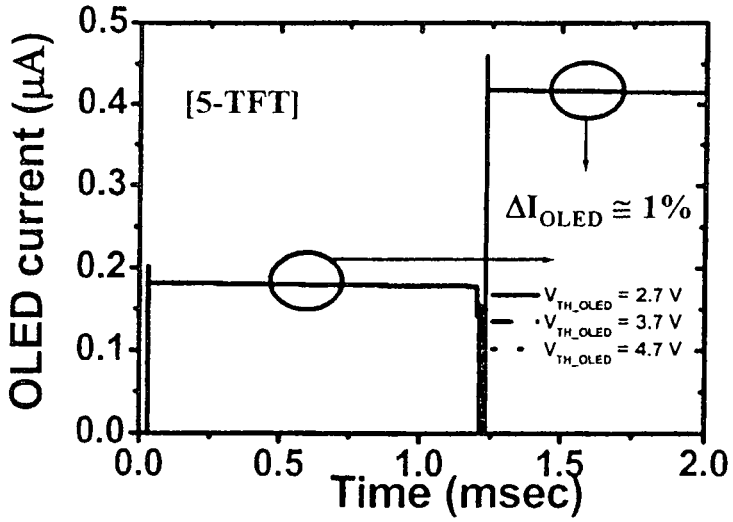
FIG. 6A shows the current deviations according to changes in OLED threshold voltage in the picture element structure as shown in FIG. 3.

FIG. 6A shows the result of simulation utilizing the picture cell scheme according to the first embodiment of the invention as shown in FIG. 3, as the threshold voltage in OLED deteriorated. According to the simulation in FIG. 6*a*, the measurement of OLED output current in case where the OLED threshold voltage deteriorates by 1V from 2.7V to 4.7V shows that it is made only 1% of error, which is substantially neglectable. Therefore, it is appreciated that according to the invention the output resistance in TFT $T_{14}$, due to $T_{15}$, is forced to increase.

Figure 6B:
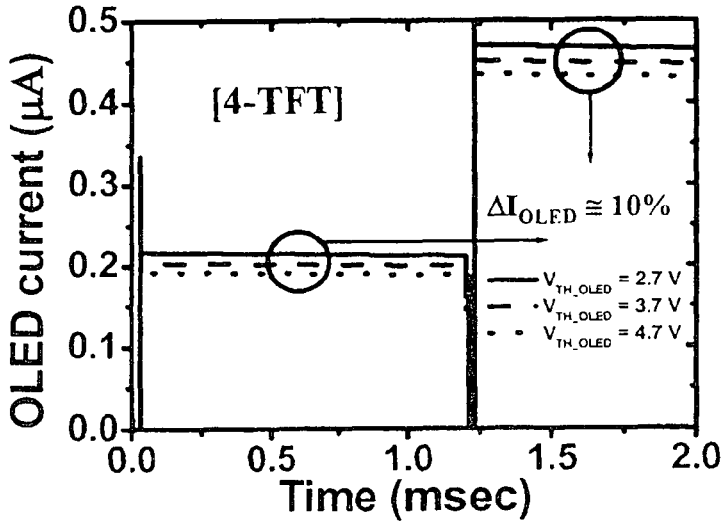
FIG. 6B shows the current deviations according to changes in OLED threshold voltage in the picture element structure as shown in FIG. 1.

FIG. 6B graphically shows the result of simulation for the OLED output current utilizing the picture cell scheme of a prior art as seen in FIG. 1, as the threshold voltage in OLED deteriorated. Here, since a change in the OLED threshold voltage makes a drain node voltage in the drive transistor $T_4$ change, it is appreciated that it is made at least 10% of error in the OLED output current.

Figure 7:
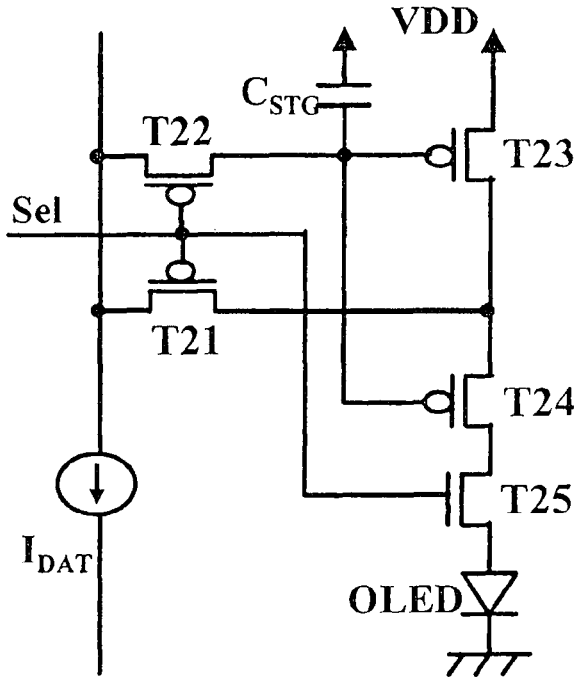
FIG. 7 schematically shows a picture element structure in a current programming type of active matrix OLED according to a second embodiment of the present invention.
Figure 8:
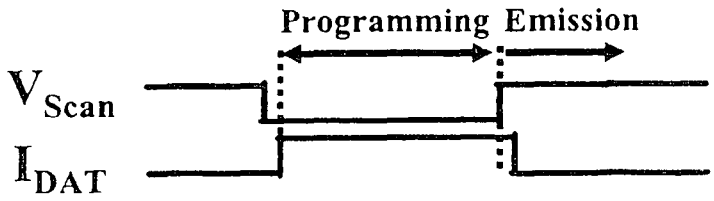
FIG. 8 shows an operation timing diagram in FIG. 7.

FIG. 7 schematically shows the structure of a picture element in a current programming type of active matrix OLED according to a second embodiment of the present invention, and FIG. 8 shows an operation timing diagram in FIG. 7. As seen in FIG. 7, the picture element in a current programming type of active matrix OLED according to this embodiment includes four P-type TFTs $T_{21}$ to $T_{24}$ and a N-type TFT $T_{25}$. Here, it is noted that the compensation for the non-uniformity electrical characteristic in TFTs will be applied in a similar manner as those heretofore described with reference to the first embodiment of the invention.

It is appreciated however, that the picture cell structure as shown in FIG. 7 could be used to get rid of such an OLED current error owing to the OLED threshold voltage deterioration, by connecting a gate node of N-type TFT $T_{25}$ with a scan signal without applying an additional signal line $V_{bias}$ used in the aforementioned first embodiment. As a result, it is noted that this embodiment will be more advantageous in use in view of an aperture ratio than the picture cell scheme as shown in the first embodiment.

Figure 9:
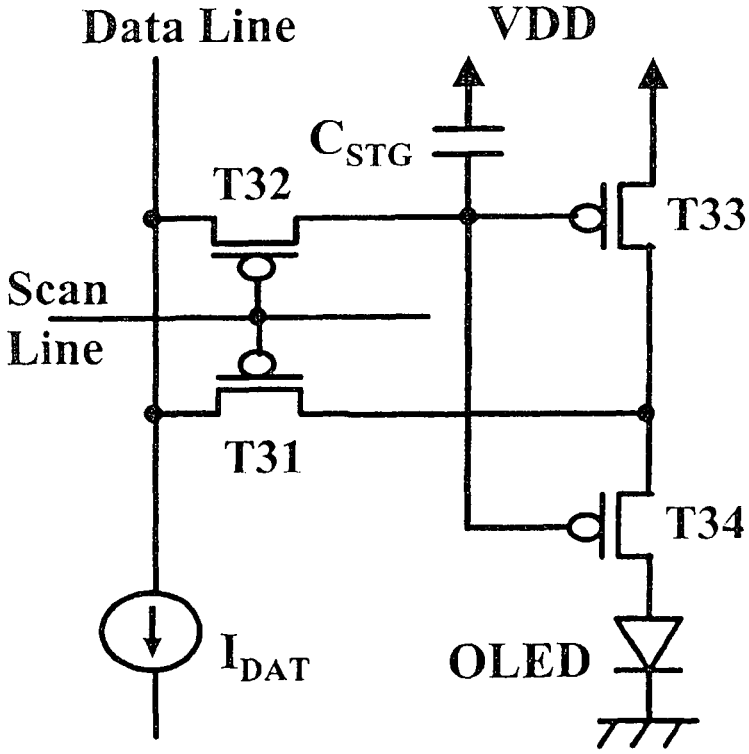
FIG. 9 schematically shows a picture element structure in a current programming type of active matrix OLED according to a third embodiment of the present invention.

FIG. 9 schematically shows a picture element structure in a current programming type of active matrix OLED according to a third embodiment of the present invention. Referring to FIG. 9, the picture element is configured to have only four transistors with TFT $T_{15}$ in the first embodiment removed, in case where no deterioration in OLED elements occurs or the OLED current error is neglectably small.

Figure 10:
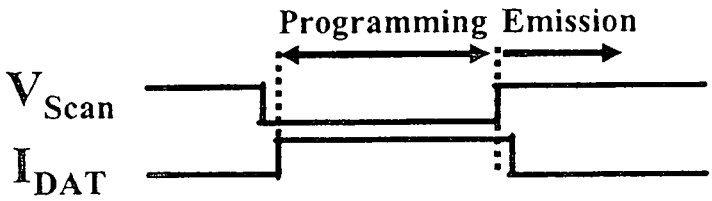
FIG. 10 shows a timing diagram of operation in FIG. 9.

Referring to FIG. 10, it is shown a timing diagram of operation in FIG. 9 and it is all the way same as FIG. 8. In the embodiment of FIG. 10, it is noted that the basic operation thereof will be substantially similar to those described in conjunction with the first embodiment, making a saturation current in TFT $T_{34}$ flow into OLED device to compensate for non-uniformity electrical characteristic in TFTs. As such, the more detailed explanation will be omitted.

Figure 11:
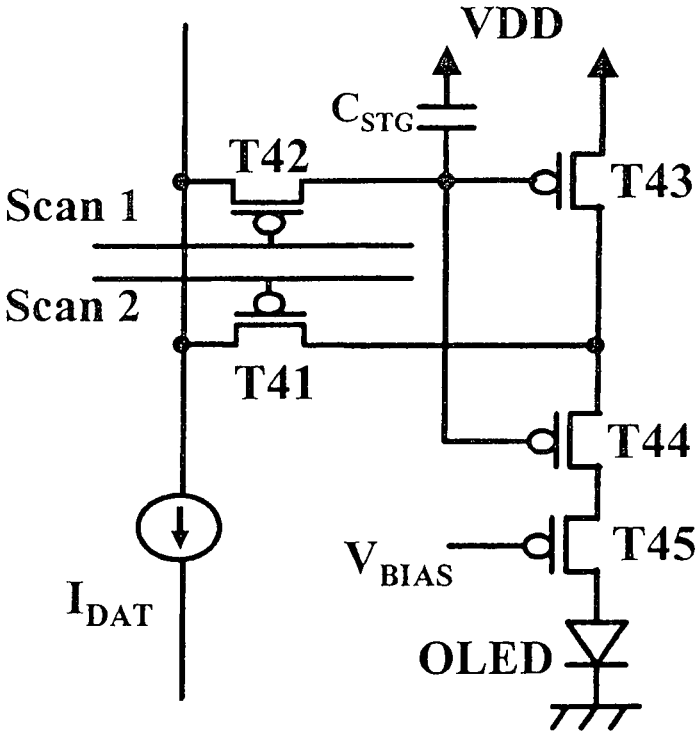
FIG. 11 schematically shows a picture element structure in a current programming type of active matrix OLED according to a fourth embodiment of the present invention.
Figure 12:
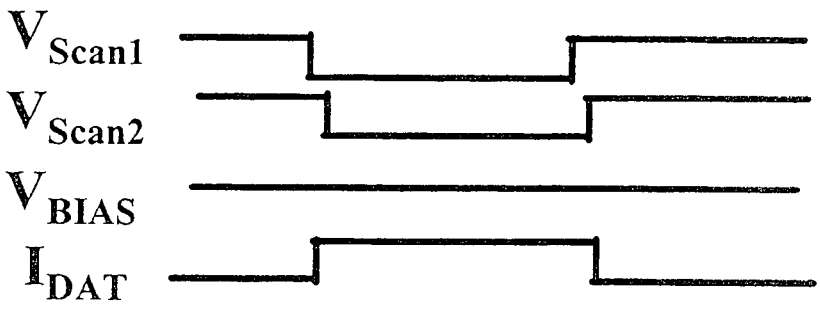
FIG. 12 shows a timing diagram of operation in FIG. 11.

FIG. 11 schematically shows the picture element structure in a current programming type of active matrix OLED according to a fourth embodiment of the present invention, and FIG. 12 shows a timing diagram of operation in FIG. 11. As seen in FIG. 11, the picture element in a current programming type of active matrix OLED according to this embodiment includes five P-type TFTs $T_{41}$ to $T_{45}$ and a capacitor $C_{STG}$, as seen in the first embodiment of FIG. 3. Here, the difference in structure between this embodiment and the first embodiment of FIG. 3 is that two scan signals are applied to effect more stable circuit operation, so that TFT $T_{41}$ is turned OFF earlier than TFT $T_{42}$ in operation. This inventive idea of controlling a switching of two TFTs $T_{41}$ and $T_{42}$ using these two scan signals may be likewise applied to all the aforementioned embodiments of the present invention and any other alternative embodiments to be discussed in the following.

Figure 13:
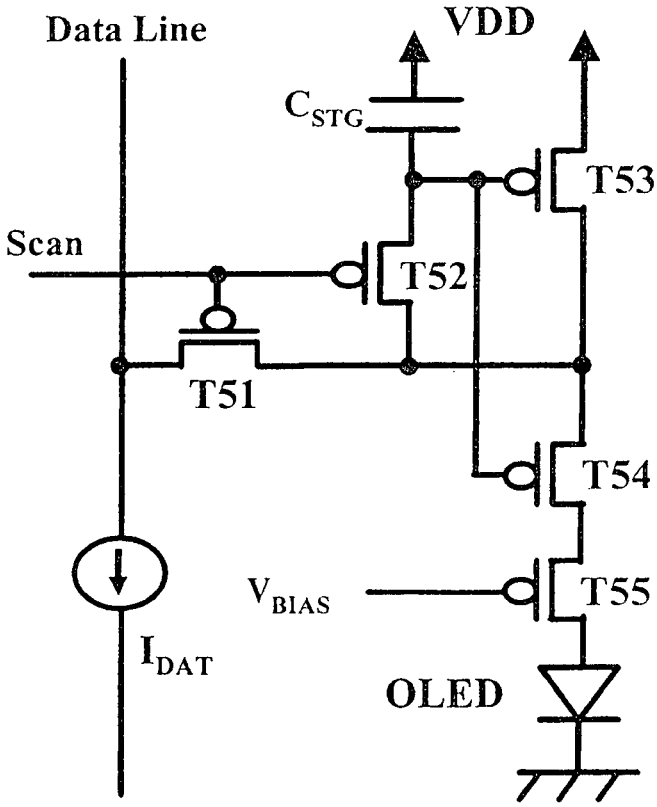
FIG. 13 schematically shows a picture element structure in a current programming type of active matrix OLED according to a fifth embodiment of the present invention.
Figure 14:
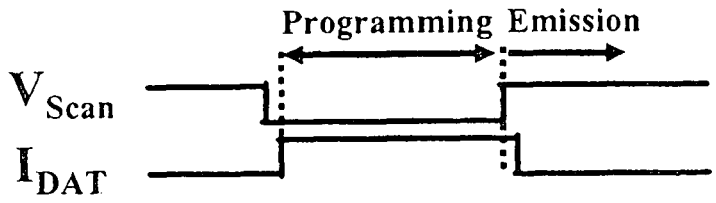
FIG. 14 shows a timing diagram of operation in FIG. 13.

FIG. 13 schematically shows the picture element structure in a current programming type of active matrix OLED according to a fifth embodiment of the present invention, and FIG. 14 shows a timing diagram of operation in FIG. 13. According to FIG. 13, it is noted that the structure of this fifth embodiment is different from that of the first embodiment in that the position of TFT $T_{52}$ is re-arranged in such a manner that the data current $I_{DATA}$ is only applied to a source of TFT $T_{51}$ and a drain of TFT $T_{52}$ is connected to a drain of TFT $T_{53}$. As seen in the timing diagram of FIG. 14, its basic operation of writing the data current into TFT $T_{53}$ upon a programming operation and then making the saturation current in TFT $T_{54}$ flow into OLED device, the saturation current being compensated for the change in threshold voltages of TFT and OLED, will be substantially same as those discussed in the first embodiment of the invention. Accordingly, more detailed explanation will be omitted for the purpose of simplicity in explanation.

Figure 15:
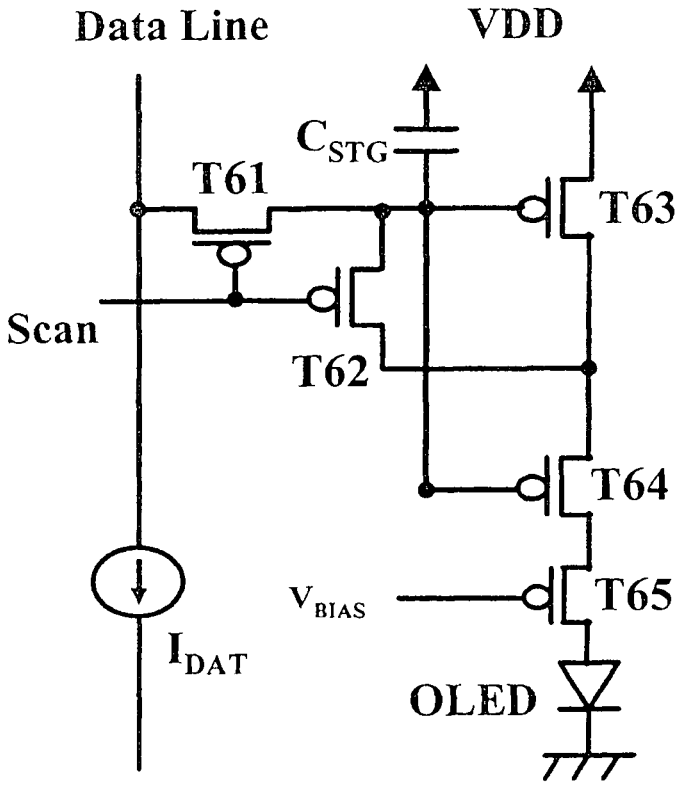
FIG. 15 schematically shows a picture element structure in a current programming type of active matrix OLED according to a sixth embodiment of the present invention.
Figure 16:
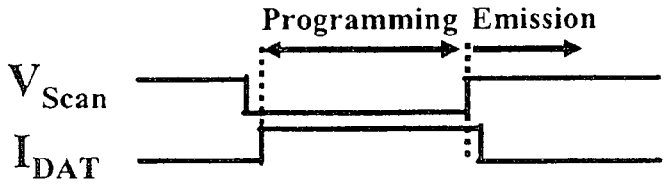
FIG. 16 shows a timing diagram of operation in FIG. 15.

FIG. 15 schematically shows the picture element structure in a current programming type of active matrix OLED according to a sixth embodiment of the present invention, and FIG. 16 shows a timing diagram of operation in FIG. 15. In the picture cell scheme shown in FIG. 13, it should be noted that the structure of this sixth embodiment is only different from that of the first embodiment of FIG. 3 in that the position of TFT $T_{62}$ is arranged such that the data current $I_{DATA}$ is only applied to a source of TFT $T_{61}$ from a gate of $T_{63}$ and a drain of TFT $T_{62}$ is connected to a drain of TFT $T_{63}$. Here, as seen in the timing diagram of FIG. 16, its basic operation of writing the data current into TFT $T_{63}$ upon a programming operation and then making the saturation current in TFT $T_{64}$ flow into OLED device, the saturation current being compensated for the change in threshold voltages of TFT and OLED will be substantially similar to those mentioned in the first embodiment. As such, more detailed explanation will be omitted for the purpose of simplicity in explanation.

The basic concept that was applied to the preferred embodiments of FIGS. 13 and 15, for outputting the compensated OLED current by changing the physical position of TFT $T_2$, may be also utilized for the third embodiment of FIG. 9 according to the present invention.

Therefore, the expert skilled in the art will well appreciate that, among the various picture element circuits configured based upon the above-described embodiments of the present invention, the picture element circuit with five TFTs may be configured with four P-type TFTs and a N-type TFT as shown in the second embodiment, so as to remove $V_{BIAS}$ line, thereby allowing to increase the aperture ratio of a display panel.

Further, the picture element configuration according to the present invention may be configured using N-type TFT as a drive transistor, in a similar way as aforementioned.

Figure 17:
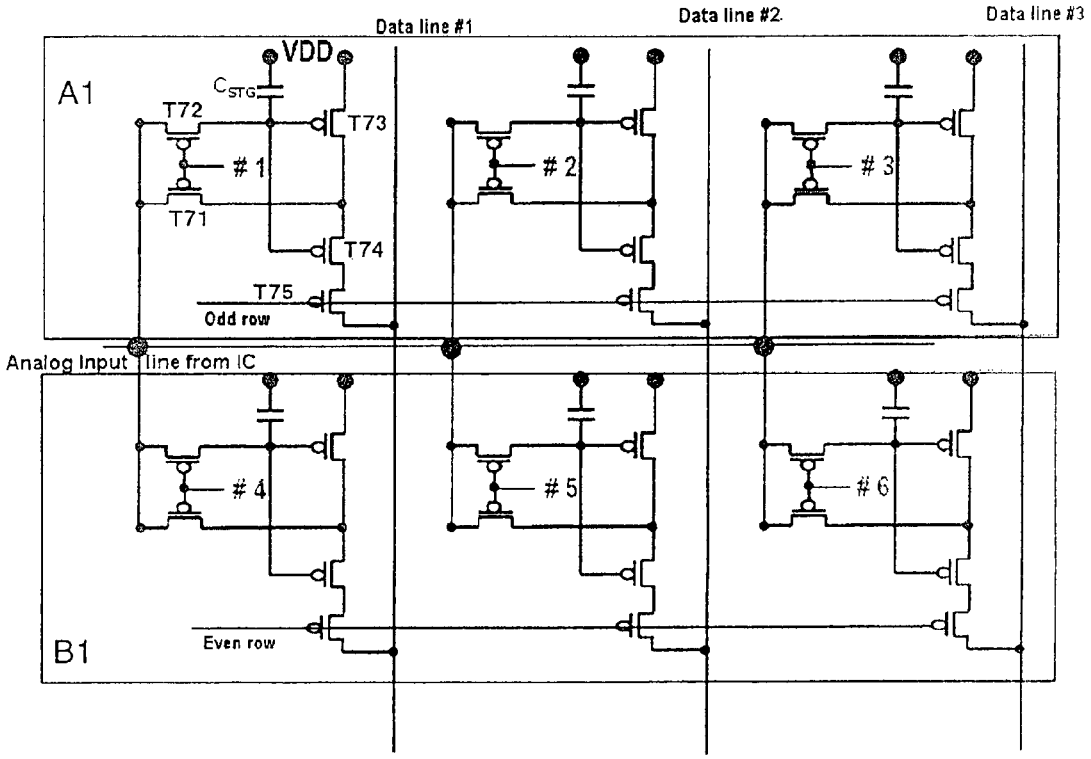
FIG. 17 schematically shows a preferred embodiment of a data driver for driving a picture element in a current programming type of active matrix OLED according to the present invention.
Figure 18:
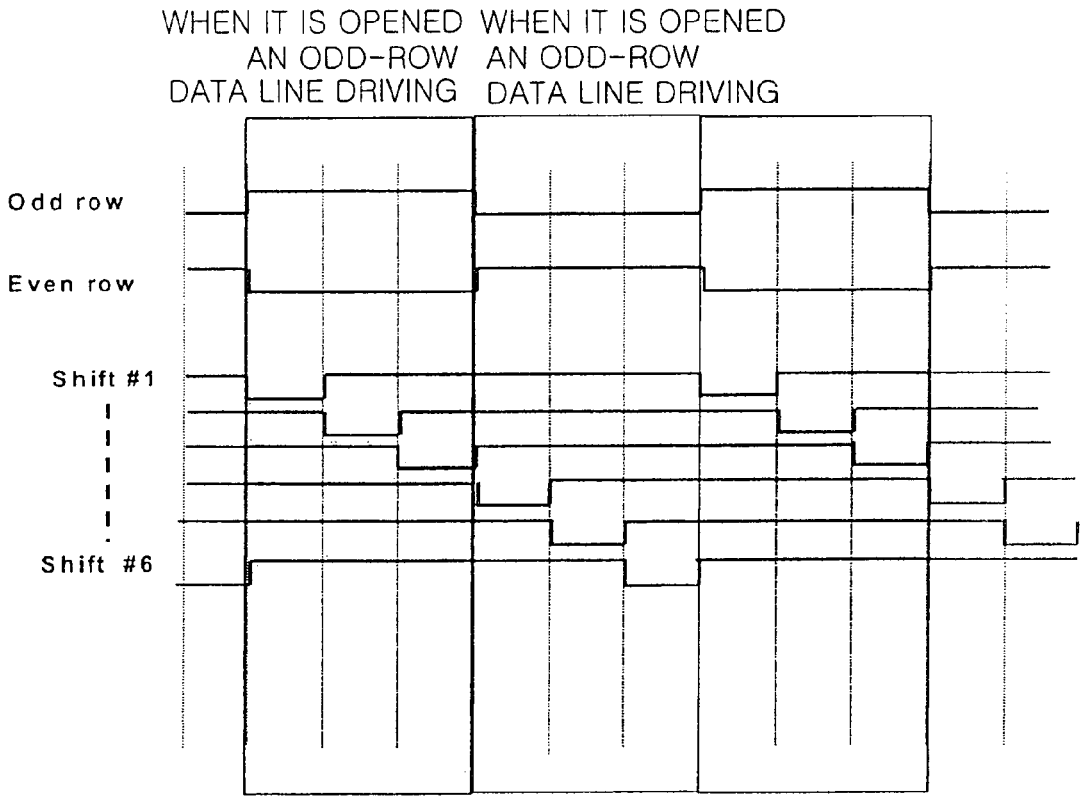
FIG. 18 shows a signal timing diagram for operating the data driver shown in FIG. 17.

FIG. 17 schematically shows a preferred embodiment of a current data driver for driving a picture element in a current programming type of active matrix OLED according to the present invention, in which the data driver is adapted to compensate for the non-uniformity electrical characteristic of TFTs in drivers. FIG. 18 shows a signal timing diagram associated with operation of the current data driver as shown in FIG. 17.

Referring now to FIGS. 17 and 18, explanation is made to a circuit operation to drive three data lines in the panel using a single external current input signal generated from an external integrated circuit.

If it is assumed that a TFT to drive picture cells in a panel is of N-type, a data current driver in the panel needs to be fabricated of a current-source type, so that the data current driver has to be fabricated of P-type. As seen in FIG. 17, two P-type current memory cells are connected in parallel for each data line in the panel. The operation will be described hereunder.

When an even-row signal of FIG. 18 goes low, current memory cells in a section B1 are allowed to simultaneously drive data lines in the panel thanks to the even-row signal while current memory cells in a section A1 are sequentially storing the currents externally supplied (e.g., shift register signals #1 to #3). Then, when it is opened an odd-row in the panel, the current memory cells in section A1 operate to simultaneously drive data lines in the panel owing to the odd-row signal, while the current memory cells in section B1 keep to store in sequence the currents externally supplied (e.g., shift register signals #4 to #6). Here, a signal input from a shift register integrated within the panel may be used for the signal of current stored in sequence. Accordingly, assuming that a single external current line is adapted to drive M data lines, it will be appreciated by an expert in the art that 2M-stage shift registers is required. Of course, assuming that it is to be driven by M-stage of shift registers, each shift register will be added by a logic gate as necessary. Further, it should be noted that because the circuit operates to provide the data line in the panel with a current reduced by a given scaling ratio with respect to the input data current, it can diminish occurrence of the signal delay problem, i.e., RC-delay, owing to a time constant in the data line.

Figure 19:
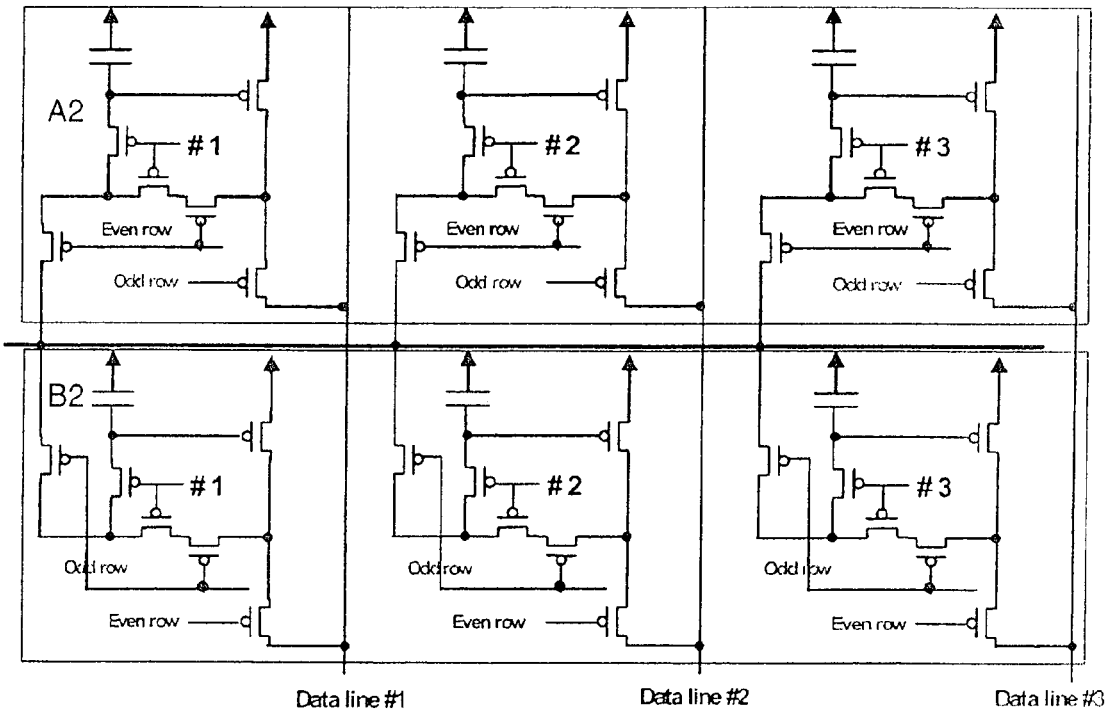
FIG. 19 schematically shows another preferred embodiment of a data driver for driving a picture element in a current programming type of active matrix OLED according to the present invention.

FIG. 19 schematically shows another preferred embodiment of a data driver for driving a picture element in a current programming type of active matrix OLED according to the present invention, wherein the data driver is adapted to compensate for the non-uniformity electrical characteristic of TFTs in the driver. Further, FIG. 20 shows a signal timing diagram associated with operating the data driver shown in FIG. 19.

Figure 20:
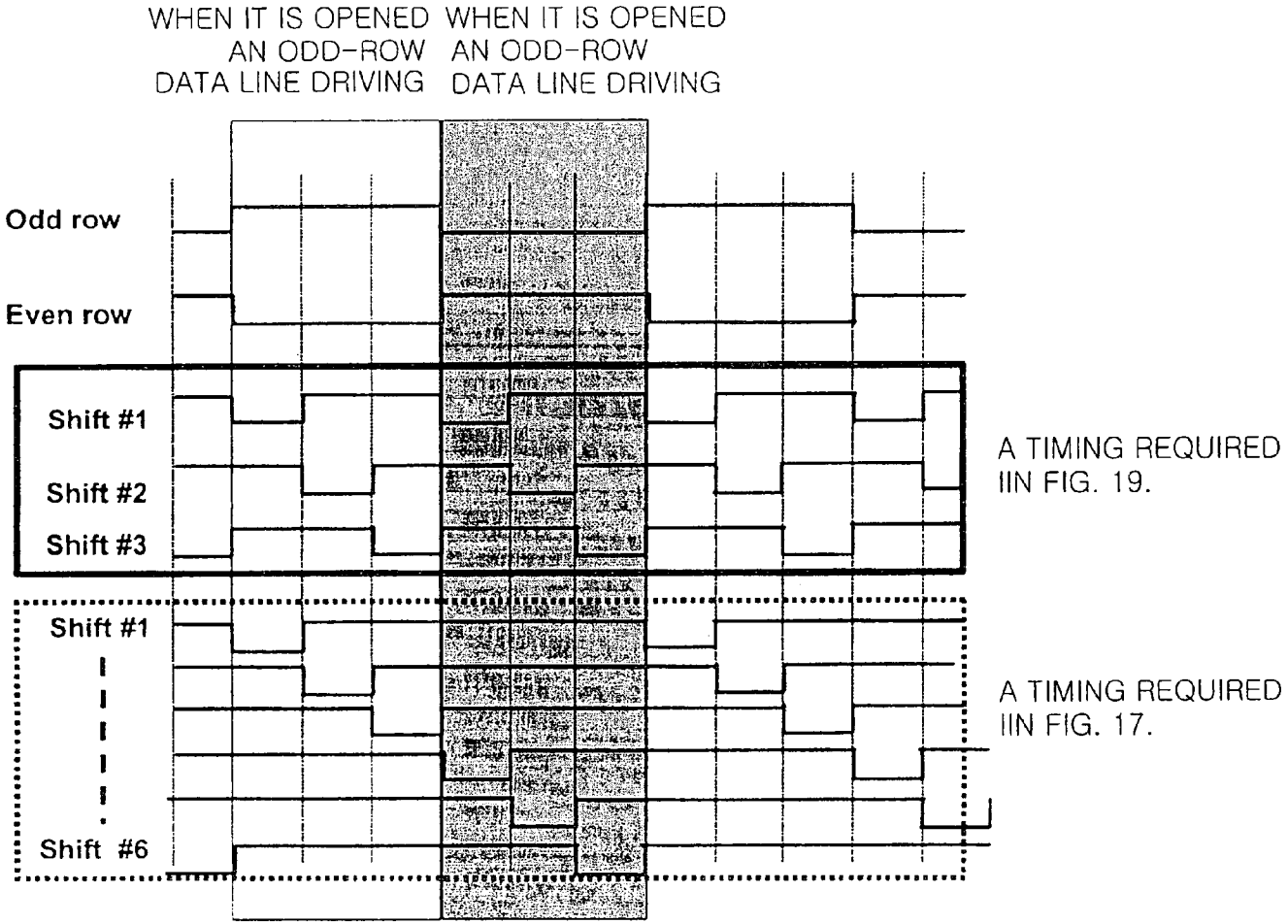
FIG. 20 shows a signal timing diagram for operating the data driver shown in FIG. 19.

In FIGS. 19 and 20, if it is assumed that a TFT to drive picture cells in a panel is of N-type, the proposed data current driver in the panel has six P-type TFTs and a capacitor. The operation will be described hereunder.

When it is opened an even-row in the panel (i.e., even-row signal), the current memory cells in section B2 operate to simultaneously drive data lines in the panel owing to the even-row signal, while the proposed current memory cells in section A2 are storing in sequence the currents externally supplied (e.g., shift register signals #1 to #3). At this time, it should be noted that although the current memory cells in the section B2 also receive the signals #1 to #3, the current externally supplied with the odd-row signal does not influence any current memory cells in the section B2, and the data driver is designed so that owing to the odd-row signal, gate electric charges memorized in its preceding stage are kept. In a similar way, when it is opened an odd-row in the panel (i.e., of odd-row signal), the current memory cells in section A2 operate to simultaneously drive data lines in the panel owing to the odd-row signal, while the proposed current memory cells in section B2 are storing in sequence the currents externally supplied (e.g., shift register signals #1 to #3). Here, it should be noted that although the current memory cells in the section A2 also receive the signals #1 to #3, the current externally supplied with the even-row signal does not influence any current memory cells in the section B2, and the data driver circuit is designed so that no influence is made by the even-row signal to the gate electric charges memorized in its preceding stage.

According to the present invention, it is noted that for the purpose of driving the current data driver circuit of FIG. 17, there are usually required two times as many stages of shift registers as the number of data lines to be driven by a single external current source.

Furthermore, it should be also noted that when utilizing the data line driver circuit of FIG. 19, there will be only required as many stages of shift registers as the number of data lines to be driven by a single external current source.

As understood from the foregoing description, the novel structure of picture elements in a current programming type of active matrix organic light emitting diode (OLED) display according to the present invention makes it possible to effectively compensate for OLED current deviations due to the deterioration in OLED as well as the non-uniformity electrical characteristic in TFT elements between picture elements. Accordingly, this structure allows for the active matrix OLED picture elements to have very uniform light emitting characteristic.

Furthermore, it will be appreciated by an expert in the art that the first embodiment of the invention has a considerable degree of advantage in a manufacturing process in that all TFTs are fabricated of p-type transistor, wherein $V_{BIAS}$ signal is further applied in addition to the essential signals, i.e., a scan signal and an $I_{DATA}$ signal, while the second embodiment has an advantage in that an additional signal line can be removed to extend a light emitting area in a picture cell, thereby effecting the substantially same operating characteristic only using those essential signals without applying the $V_{BIAS}$ signal. Consequently, it is appreciated that the picture cell configuration according to the present invention provides an excellent operating characteristic capable of outputting the same OLED current for the same data input in spite of some degree of changes in threshold voltages in TFTs and OLEDs. As a result, it will become possible to implement more competitive display devices as compared to those with a conventional picture cell configuration.

In the mean time, it is noted in the state of the art that most of the known current programming type picture cell schemes are generally configured so that a data current applied upon selection of a picture cell flows into OLED with a scaling downed current in a current-mirror or with the same current value as the data current after the selection of a picture cell. Therefore, considering the material characteristic of OLED which needs to represent high quality of gray scale within a range of 1 μA to 2 μA at the maximum, it will require a data current driver capable of controlling in scale of a few tens of nA. In contrast, the picture cell structure in a current programming type of active matrix OLED display according to the present invention makes it possible to drive the OLED with an increased data current controlled by the better scaling-down ratio in comparison to a current scaling-down ratio in a current-mirror, so it has an advantage in that design of such a current driver becomes easier than that of a prior art, and a data line charging time is reduced.

While the preferred embodiments of the present invention have been illustrated and described, it will be understood by those skilled in the art that various changes and modifications may be made, and equivalents may be substituted for elements thereof without departing from the true scope of the present invention. Therefore, it is intended that the present invention not be limited to the particular embodiment disclosed as the best mode contemplated for carrying out the present invention; instead, it is intended that the present invention include all embodiments falling within the scope of the appended claims.

What is claimed is:

1. A picture element structure in a current programming type of active matrix organic light emitting diode (OLED), comprising:

first and second transistors for selecting a driving picture element based upon a scan signal applied from an exterior, said first and second transistors being adapted to receive a data current;

a capacitor for storing electric charges applied from the first and second transistors;

a third transistor adapted to be selected by the first and second transistors, for writing the data current thereto and receiving an external power source;

a fourth transistor having a gate that is coupled to a gate of the third transistor, for receiving a voltage based upon the electric charges stored in the capacitor to supply a current to a corresponding picture element, wherein gate voltages of the third transistor and fourth transistor are always equal to each other;

an organic light emitting diode (OLED) for emitting light by a current flowing through said fourth transistor; and a fifth transistor connected in series to the fourth transistor and formed of a conductivity type of transistors different from that of said first to fourth transistors having the same conductivity type of transistors, a gate of said fifth transistor being coupled with a scan line, wherein during a gate selection session for writing the data current to the third transistor, the scan signal is low, the first and second transistors are turned on, the third transistor operates in a saturation area and the fourth transistor is turned off, and wherein after the gate selection session, the scan signal is high, the first and second transistors are turned off, the third transistor operates in a linear area, the fourth transistor operates in a saturation area, and a current $I_{OLED}$ flows through the third transistor operating in the linear area and the fourth transistor operating in the saturation area so that the current IOLED is scaled down compared with the data current.

2. The picture element structure in a current programming type of active matrix organic light emitting diode (OLED) according to claim 1, wherein the magnitude of the current applied to the corresponding picture element is operatively controllable depending upon a ratio of channel width/channel length (W/L) in the third transistor and channel width/channel length (W/L) in the fourth transistor.

3. A picture element structure in a current programming type of active matrix organic light emitting diode (OLED) having at least one scan line, at least one data line and a power supply source, comprising:

a capacitor connected to the power supply source, for storing electric charges supplied to said data line;

a first transistor having a P-type thin film transistor, of which gate is connected to the scan line and source/drain current path is connected to the data line;

a second transistor having a P-type thin film transistor, of which gate is connected to the scan line and source/drain current path is formed between said capacitor and said first transistor;

a third transistor having a P-type thin film transistor, of which gate is connected to the capacitor and source/drain current path is formed between said power supply source;

a fourth transistor having a P-type thin film transistor, of which gate is connected to the gate of the third transistor and source/drain current path is connected in said third transistor, wherein gate voltages of the third transistor and fourth transistor are always equal to each other; and an organic light emitting diode (OLED) for emitting light by a current flowing through said fourth transistor, wherein during a gate selection session for writing the data current to the third transistor, the scan signal is low, the first and second transistors are turned on, the third transistor operates in a saturation area and the fourth transistor is turned off, and wherein after the gate selection session, the scan signal is high, the first and second transistors are turned off, the third transistor operates in a linear area, the fourth transistor operates in a saturation area, and a current $L_{OLED}$ flows through the third transistor operating in the linear area and the fourth transistor operating in the saturation area so that the current IOLED is scaled down compared with the data current.

4. A picture element structure in a current programming type of active matrix organic light emitting diode (OLED), comprising:

first and second transistors for selecting a driving picture element based upon a scan signal applied from an exterior, said first and second transistors being adapted to receive a data current;

a capacitor for storing electric charges applied from the first and second transistors;

a third transistor adapted to be selected by the first and second transistors, for writing the data current thereto and receiving an external power source;

a fourth driving transistor having a gate that is coupled to a gate of the third transistor, for receiving a voltage based upon the electric charges stored in the capacitor to supply a current to a corresponding picture element, wherein gate voltages of the third transistor and fourth transistor are always equal to each other;

an organic light emitting diode (OLED) for emitting light by a current flowing through said fourth transistor; and a fifth transistor connected in series to the fourth driving transistor, for making an output resistance of the fourth driving transistor increase to eliminate a kink-effect current drop, wherein said fifth transistor having a biasing connection so that said fifth transistor is always in a turned on state, wherein during a gate selection session for writing the data current to the third transistor, the scan signal is low, the first and second transistors are turned on, the third transistor operates in a saturation area and the fourth transistor is turned off, and wherein after the gate selection session, the scan signal is high, the first and second transistors are turned off, the third transistor operates in a linear area, the fourth transistor operates in a saturation area, and a current IOLED flows through the third transistor operating in the linear area and the fourth transistor operating in the saturation area so that the current IOLED is scaled down compared with the data current.

* * * * *

UNITED STATES PATENT AND TRADEMARK OFFICE

CERTIFICATE OF CORRECTION

PATENT NO. : 8,427,398 B2
APPLICATION NO. : 11/351134
DATED : April 23, 2013
INVENTOR(S) : Min-Koo Han et al.

It is certified that error appears in the above-identified patent and that said Letters Patent is hereby corrected as shown below:

On the Title Page item (54) and in the specification, col. 1, line 1, the Title of the patent should read as follows:
--...PICTURE ELEMENT STRUCTURE OF CURRENT PROGRAMMING METHOD TYPE ACTIVE MATRIX ORGANIC EMITTING DIODE DISPLAY AND DRIVING METHOD OF DATA LINE...--

Signed and Sealed this
Fourth Day of June, 2013

Teresa Stanek Rea
*Acting Director of the United States Patent and Trademark Office*